US008890398B2

(12) United States Patent
Schenk et al.

(10) Patent No.: US 8,890,398 B2
(45) Date of Patent: Nov. 18, 2014

(54) SPARK PLUG FOR GASOLINE ENGINES

(75) Inventors: Alexander Schenk, Waiblingen (DE); Werner Niessner, Steinheim (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 369 days.

(21) Appl. No.: 13/334,055

(22) Filed: Dec. 22, 2011

(65) Prior Publication Data

US 2012/0326591 A1 Dec. 27, 2012

(30) Foreign Application Priority Data

Dec. 22, 2010 (DE) ..... 10 2010 061 507
Apr. 19, 2011 (DE) ..... 10 2011 002 167

(51) Int. Cl.
*H01T 13/20* (2006.01)
*H01T 13/32* (2006.01)
*H01T 13/14* (2006.01)

(52) U.S. Cl.
CPC ..... *H01T 13/32* (2013.01); *H01T 13/14* (2013.01)
USPC ..... 313/142; 313/141

(58) Field of Classification Search
USPC ..... 313/118–145
See application file for complete search history.

(56) References Cited

U.S. PATENT DOCUMENTS

| | | | | |
|---|---|---|---|---|
| 1,982,950 | A | 1/1933 | Curtis | |
| 4,983,877 | A * | 1/1991 | Kashiwara et al. | 313/140 |
| 5,144,188 | A * | 9/1992 | Kagawa et al. | 313/11.5 |
| 5,929,556 | A | 7/1999 | Matsubara | |
| 6,307,307 | B1 * | 10/2001 | Kanao | 313/142 |

FOREIGN PATENT DOCUMENTS

| | | |
|---|---|---|
| AT | 116241 | 12/1942 |
| DE | 69622818 T2 | 5/1997 |
| DE | 102006033578 A1 | 1/2008 |
| GB | 715153 A | 9/1954 |

* cited by examiner

*Primary Examiner* — Andrew Coughlin
(74) *Attorney, Agent, or Firm* — Reising Ethington P.C.

(57) ABSTRACT

Described is a spark plug for gasoline engines with an elongated hollow body made of metal, said body having a forward end with an undercut formed by an interior annular shoulder of the body and a rear end, with an elongated ceramic insulator which is mounted in the body and has a rear end that projects beyond the rear end of the body and has a forward end beyond which the forward end of the body projects, with a center electrode which is inserted into the insulator, projects beyond the forward end thereof, and is connected to a metal connection pin in an electrically conductive manner, said connection pin projecting beyond the rear end of the insulator, and with at least one ground electrode which starts from the forward end of the body and is approached to the center electrode to an electrode distance (EA) to form a spark gap.

18 Claims, 4 Drawing Sheets

Figur 6
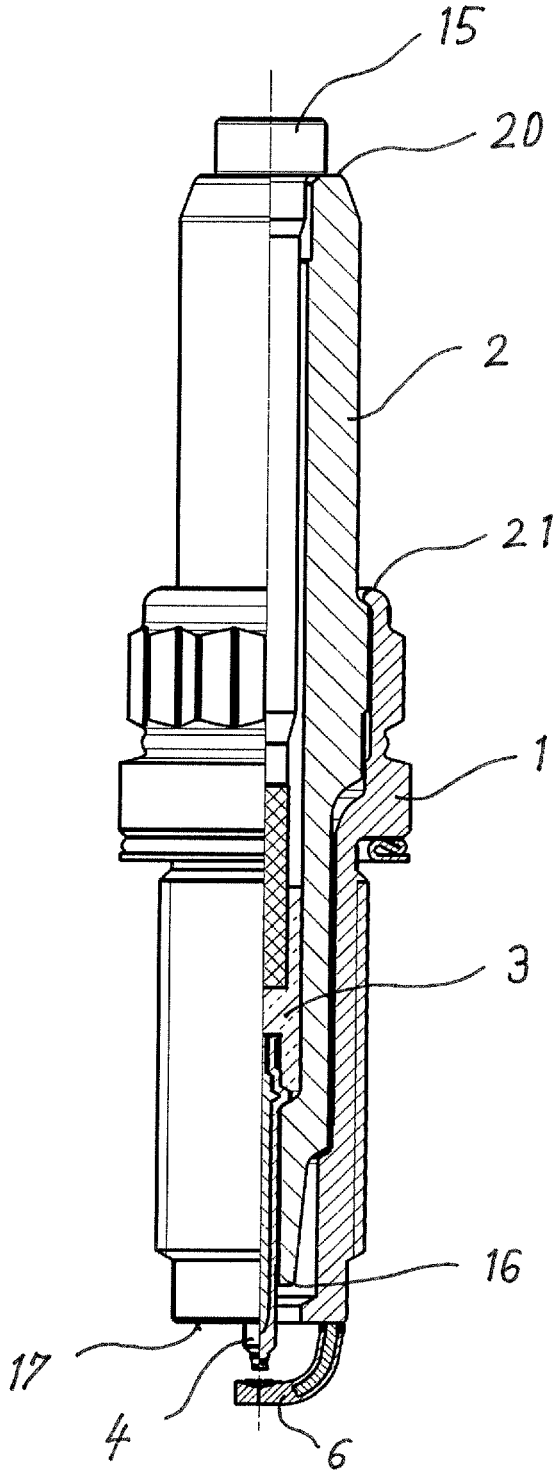

SPARK PLUG FOR GASOLINE ENGINES

The invention is related to a spark plug having the features presented in the preamble of Claim 1. Such a spark plug is known from the Austrian patent publication No. 116241. In this known spark plug, the insulator is retracted well into the metal body which forms the housing of the spark plug and is, in addition, protected by a metal neck attached to the front side of the insulator, wherein the center electrode of the spark plug protrudes from said metal neck and projects a little out of the metal body forming the housing of the spark plug. This is to prevent a failure of the insulator caused by cracking of the insulator and by formation of a conducting soot bridge.

Complex designs of spark plugs, as they are known from the Austrian patent publication 116241, have no longer been in use for a plurality of decades because the quality of the ceramic insulators could be improved to such an extent that it was more favorable to have the front side of the insulator project beyond the front edge of the metal body forming the housing of the spark plug rather than displace said front side of the insulator into the rear of the metal housing.

Due to recent developments in motor engineering, particularly due to the downsizing of gasoline engines, the impacts to which the spark plugs are exposed have considerably increased in the meantime. Downsizing means that it is attempted to reduce the engine displacement of the engines without reducing the engine output, preferably to even further increase the engine output, particularly by using turbochargers with high mean effective pressures of up to 25 bar. This gives rise to new problems, and old problems which had already been overcome for engines that were less highly developed, e.g., pre-ignition and knocking as a concomitant phenomenon of uncontrolled combustion, are re-emerging, wherein, however, the harmful consequences of uncontrolled combustion are more grave than before due to the high compression in the highly developed modern engines.

Uncontrolled combustion may result in what are called megaknocks, the strong pressure waves or shock waves of which, in turn, may result in a breakage of the ceramic insulator and hold the risk of an engine failure. If coming into contact with the ceramic insulator, the fuel that is injected under high pressure can trigger a temperature shock which leads to cracks in the ceramic. Cracks and breakages in the ceramic insulator may also be generated by "scavenging". Scavenging is to be understood as the mixing of fresh gases and exhaust gases in the space between the cylinder exhausts and a turbocharger of a four-stroke engine during the charge cycle. The mixing is the result of an overlap of the opening times of exhaust valves and intake valves of the four-stroke engine. Scavenging results in an increase of the speed of the turbocharger and in a desired increase of the output of the engines at low engine speed, but increases the thermal alternating stress of the spark plugs and is accompanied by the risk of ceramic cracks and ceramic breakages. The knocking limit, i.e., the moment at which knocking occurs for the first time, prevents operation of the gasoline engine with an ignition angle that is optimal for combustion; it would be easier to approach said optimal ignition angle if spark plugs were available which are more robust than present spark plugs, particularly more insensitive to the stress caused by knocking.

The object of the present invention is to create such a more robust spark plug which has a longer service life in modern high-output engines than conventional spark plugs, more particularly in high-output engines which are the result of downsizing.

This object is reached by a spark plug having the features presented in Claim 1. Advantageous refinements of the spark plug are the subject of the subclaims.

The invention has essential advantages:

- The exposed front section of the insulator that faces the combustion chamber of the engine, said section hereinafter also being referred to as insulator foot, is shielded and protected by the spark plug design according to the invention such that shock waves triggered by uncontrolled combustion and temperature shocks by fresh gas scavenging or moistening with fuel do not have any effects on the service life of the spark plug.
- The spark plug design according to the invention does not make the manufacture of the spark plug more expensive as compared with conventional spark plugs, but makes it less expensive as compared with the spark plug known from the Austrian patent publication No. 116241.
- Although the forward end of the insulator is displaced into the hollow metal body which forms the housing of the spark plug, it is still positioned near the interior annular shoulder of the metal body. The center electrode which forms one of the ends of the spark gap and, for this purpose, projects a little beyond the forward end of the metal body can, therefore, be kept short whereby the thermal load of the insulator caused by the heat absorption of the center electrode is kept low.
- The dimensions provided according to the invention shield the insulator to a sufficiently high degree and, at the same time, ensure that uncontrolled and undesired electric discharges in the vicinity of the breathing space of the spark plug are prevented, with the result that stable spark discharges only take place along the spark gap provided to that end between the center electrode and the ground electrode. The breathing space of the spark plug is to be understood as the free air space present in the hollow metal body, with the insulator projecting into said free air space with its forward end and the center electrode passing through said free air space.
- Shock waves which may originate from irregular combustion do not reach the insulator foot or, at the most, do this when they are weakened to such a degree that this does not cause any mechanical damage to the insulator.
- The spark plug design according to the invention prevents the insulator foot from being hit by cool fuel droplets.
- Temperature shocks which are caused by cold intake air in the cylinder of the engine, particularly during scavenging processes as a consequence of high valve overlaps, cannot enter into the shielded breathing space. At least, the entrance of intake air into the breathing space is reduced to such an extent that damage to the insulator is not to be expected therefrom.

According to the invention, the distance of the center electrode from the annular shoulder and the distance of the exposed forward end of the insulator from the metal body are greater than or equal to the 1.2-fold electrode distance, and the distance of the forward end of the insulator from the front side of the annular shoulder is no more than 2 mm plus the 1.2-fold electrode distance, preferably no more than 1.5 mm plus the 1.2-fold electrode distance, more preferably only 1.3 mm plus the 1.2-fold electrode distance. On the one hand, this ensures good shielding of the breathing space of the spark plug and of the insulator foot projecting into said breathing space as well as a heat absorption of the center electrode projecting beyond the insulator that is as low as possible.

The annular shoulder which shields the breathing space of the spark plug may be displaced back into the metal body of the spark plug as compared with the front side of said metal body. Preferably, however, the front side of the annular shoulder coincides with the front side of the metal body, this resulting in a compact design in the vicinity of the forward end of the spark plug, said compact design allowing a particularly short projecting length of the center electrode despite the displacement of the forward end of the insulator into the breathing space.

Preferably, the annular shoulder is delimited by a cylindrical bore the axis of which coincides with the longitudinal axis of the center electrode and, preferably, the length of the bore and, therefore, the height of the annular shoulder are less than the thickness of the adjacent circumferential wall of the metal body. This ensures that the heat transmitted by the combustion processes to the annular shoulder can properly discharge into the metal body of the spark plug. The cooler the annular shoulder remains, the better it thermally shields the insulator foot and dissipates the heat of the ground electrode.

Preferably, the annular shoulder has a conical upper side that faces the insulator, with the result that the height of the annular shoulder is radially increased from within outward. This promotes the heat discharge from the annular shoulder into the metal body. The angle measured between the longitudinal axis of the center electrode and the conical upper side of the annular shoulder, preferably, is 30° to 75°, more preferably 50° to 60°.

Appropriately, the cavity of the metal body is a stepped bore throughout the body into which bore the insulator is inserted from behind until it abuts against the step of the stepped bore with a shoulder delimiting the insulator foot. This allows positioning the insulator in the metal body in a reproducible manner.

The forward end of the insulator does not have to be blunt but is, preferably, blunt wherein the edge of the blunt front side is, preferably, rounded a little. This has proved to be favorable for the durability of the insulator.

The breathing space and the insulator are shielded to a particularly high extent when the annular shoulder partially overlaps the forward blunt end of the insulator, i.e., when the inside diameter of the annular shoulder is less than the outside diameter of the blunt end of the insulator. To achieve this, the center electrode is, preferably, designed such that it is tapering in the area between the forward end of the insulator and the narrowest point of the annular shoulder, more particularly tapering conically, mainly then when the upper side of the annular shoulder is, likewise, conical as preferred.

Preferably, the insulator is also tapering towards its forward end, particularly conically, irrespective of the fact that the forward end of the insulator is, preferably, designed blunt. Preferably, the tapering section of the insulator is arranged immediately adjacent to the forward blunt end thereof. The angle between the longitudinal axis of the center electrode and the conically tapering upper side of the insulator is, appropriately, less than 10°, preferably 5° to 7°.

Exemplary embodiments of the invention are presented in the enclosed drawings. In the different examples, equal or corresponding parts are designated with consistent reference symbols.

FIG. 1 shows, in one half, a lateral view and, in the other half, a sectional view of a spark plug according to the invention;

FIG. 2 again shows, in one half, a lateral view and, in the other half, a sectional view of the forward end of the spark plug of FIG. 1, with the specification of dimensions which should best be kept;

FIG. 6 shows the complete spark plug of FIG. 1 in a view according to FIG. 1.

Figure 1:
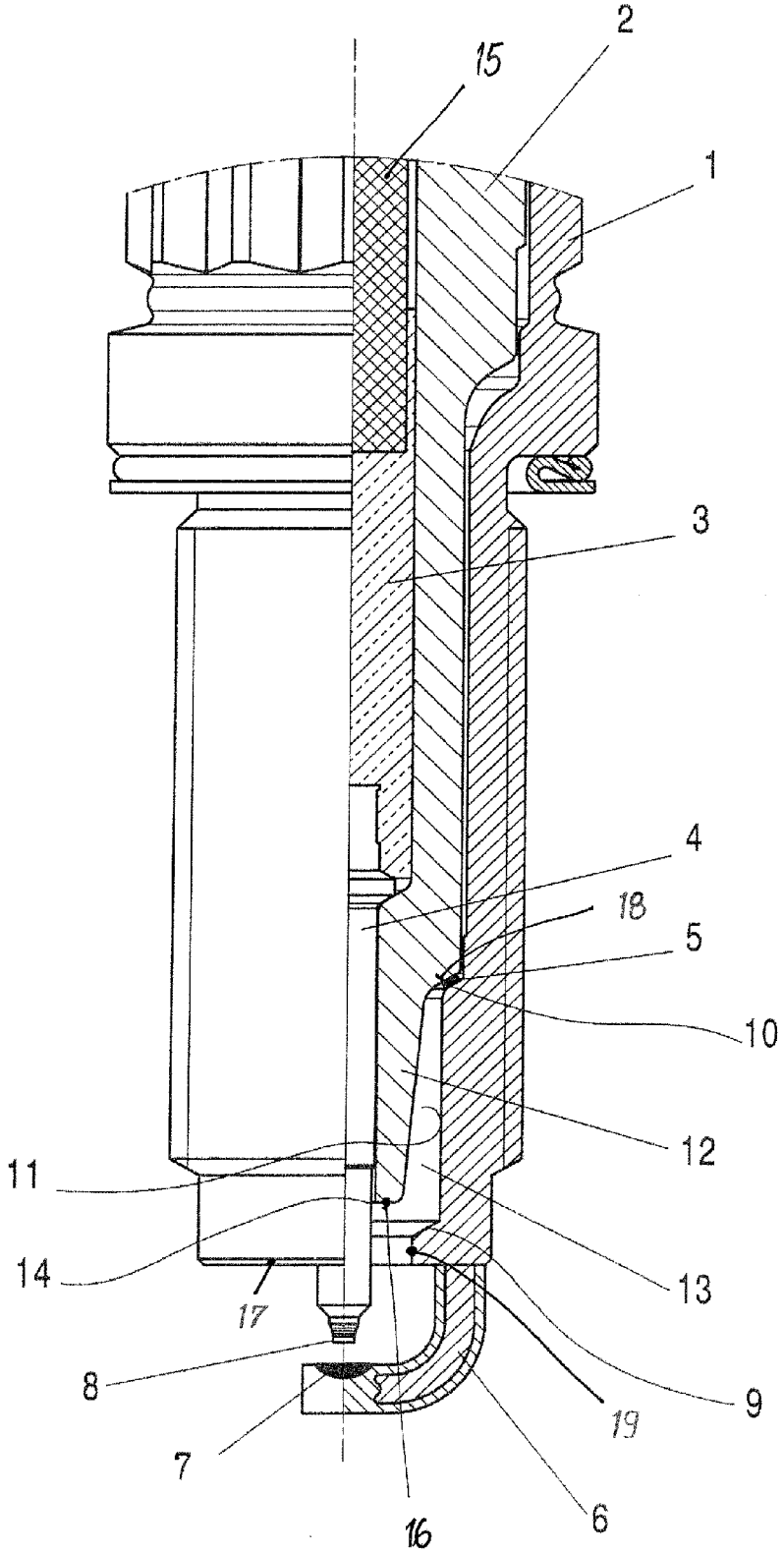

FIGS. 1 and 6 show a spark plug with a hollow metal body 1 which forms the housing of the spark plug and receives an elongated ceramic insulator 2. The body 1 has a forward end 17 and a rear end 21. The insulator 2 which is mounted in the body 1 has a rear end 20 that projects beyond the rear end 21 of the body 1 and has a forward end 16 beyond which the forward end 17 of the body 1 projects. A center electrode 4 is inserted in the insulator 2, said center electrode 4 projecting beyond the forward end 16 of the insulator 2 and beyond the forward end 17 of the body 1 and being equipped with a noble metal piece 8. An annular gap 14 surrounding the center electrode 4 is arranged in the insulator 2 at the forward end 16 thereof, see FIG. 1. The center electrode 4 is connected in an electrically conductive manner to an ignition pin 15 which is also inserted into the insulator 2 and, as is usual with spark plugs, projects from the rear end 20 of the insulator 2 and serves to establish a contact with a spark plug connector, with the high voltage required for generating ignition sparks being supplied via said contact. The electrically conducting connection between the center electrode 4 and the ignition pin 15 is achieved through a solidified glass melting 3 which contains electrically conducting pigments, e.g., soot.

The body 1 is provided with a stepped bore 11 going longitudinally through the body 1. With a complementary shoulder 18, the insulator 2 abuts against a sealing shoulder 10 of the stepped bore 11. A sealing ring 5 which seals the unavoidable annular gap between the body 1 and the insulator 2 is provided between the shoulder 18 and the sealing shoulder 10. Starting from the shoulder 18, the insulator 2 is conically tapering towards its forward end 16 that has a blunt design. In the present case, the angle $\beta$ between the longitudinal axis of the center electrode 4 and the conical peripheral surface of the front section 12 of the insulator 2 is 6°.

Figure 3:
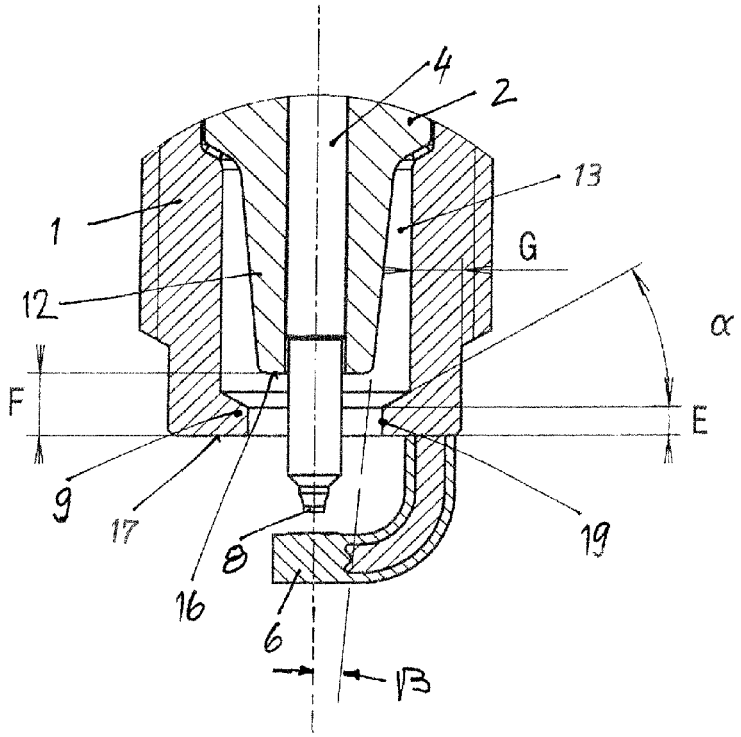
FIG. 3 shows a sectional view of the forward end of the spark plug of FIG. 1, with the specification of further dimensions which should best be kept.

A further annular shoulder 9 is provided at the forward end 17 of the body 1. Its upper side 9*a* facing the insulator 2 has a conical design. The angle $\alpha$ between the conical surface and a plane perpendicularly cutting the longitudinal axis of the inner conductor 4 is 15° to 60° and, as shown in FIG. 3, is, preferably, $\alpha$=30°.

A ground electrode 6 being designed as a top electrode starts from the forward end 17 of the body 1, which ground electrode 6, along with the center electrode 4, forms an ignition gap having the electrode distance EA. The ground electrode 6 is equipped with a noble metal piece 7.

The air space in the body 1 between its sealing shoulder 10 and its forward end 17 is referred to as breathing space 13. Its geometry is essential, on the one hand, for a reliable ignition of the spark plug and, on the other hand, for shielding the insulator foot 12 against influences which might damage the insulator 2. The distance A between the forward end 16 of the insulator 2 and the upper interior edge of the annular shoulder 9 should at least be the 1.2-fold of the electrode distance EA. The distance B of the exterior edge of the blunt front side of the insulator 2 and the circumferential wall of the body 1 should also be at least equal to the 1.2-fold electrode distance EA. The distance C of the exterior edge of the blunt front side of the insulator 2 and the conical upper side 9*a* of the annular shoulder 9 should also be at least equal to the 1.2-fold electrode distance EA. Finally, the distance D between the center electrode 4 and the annular shoulder 9 at the point where it is designed as cylindrical bore 19, should also be at least equal to the 1.2-fold electrode distance EA. This is to ensure that ignition sparks only occur between the center electrode 4 and the ground electrode 6. On the other hand, the distance F between the blunt front side of the insulator 2 and the front side 17 of the body 1 should not be in excess of the 1.2-fold of the electrode distance plus 1.5 mm, with the result that the height E of the annular shoulder 9, when measured at the interior edge thereof, should not be in excess of 1.5 mm, more preferably not in excess of 1.2 mm. This is favorable for keeping the length of the center electrode 4 projecting from the insulator 2 short and the thermal load of the insulator 2 low.

Furthermore, the height of the annular shoulder 9 should be less than the thickness G of the circumferential wall of the body 1, said circumferential wall being arranged adjacent to the annular shoulder 9, in order to ensure that any combustion heat transmitted to the annular shoulder 9 can discharge into the metal body 1 as perfectly as possible.

The noble metal pieces 7 and 8 which can be fitted on the center electrode 4 and the ground electrode 6, for example, consist of platinum or iridium or alloys thereof and prevent or reduce any wear of the two electrodes 4 and 6.

Preferably, the dimensions A, B, C and D are selected such that they are equal. Preferably, E is less than 1.0 mm and, preferably, G is greater than 1.5 mm.

Figure 2:
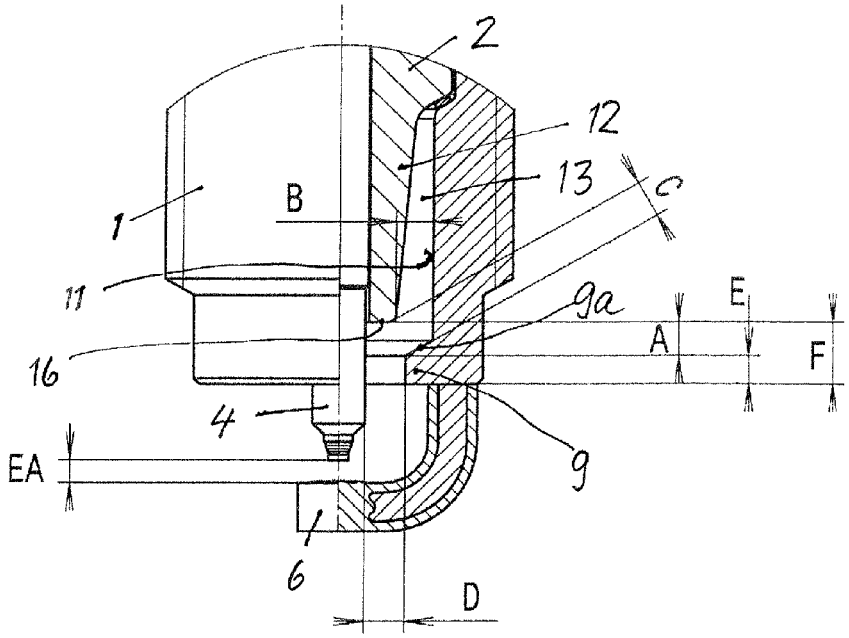
Figure 4:
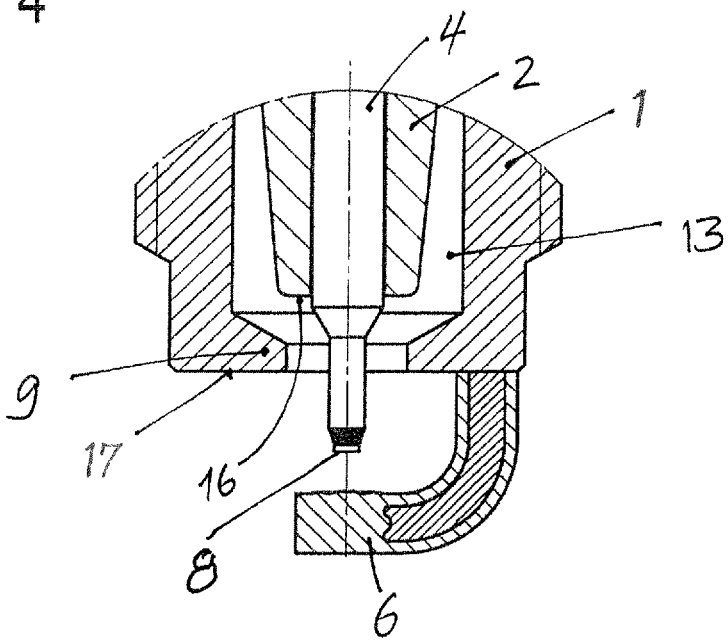
FIG. 4 shows the forward end of a modified spark plug in a longitudinal sectional view according to FIG. 3.
Figure 5:
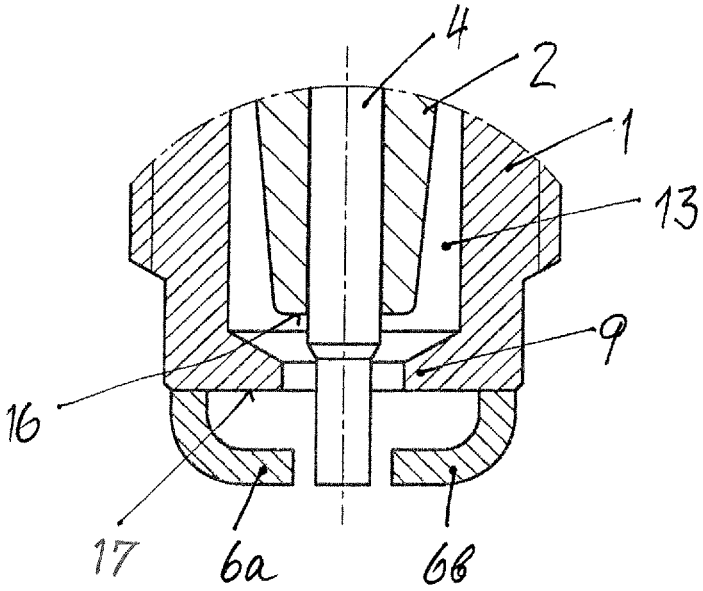
FIG. 5 shows the forward end of a further modified spark plug in a longitudinal sectional view according to FIG. 3.

In the exemplary embodiment shown in FIGS. 1 to 3, the diameter of the blunt end of the insulator 2 is a little less than the clear diameter of the annular shoulder 9. This is different in the example shown in FIGS. 4 and 5: There, the clear diameter of the annular shoulder 9 is less than the diameter of the blunt forward end 16 of the insulator 2. To allow this, the center electrode 4 is conically tapering in the area between the forward end 16 of the insulator 2 and the narrowest point of the annular shoulder 9. Furthermore, the exemplary embodiment shown in FIG. 5 is different from the exemplary embodiments shown in FIGS. 1 to 4 in that, instead of a ground electrode 6 that is designed as a top electrode, two mutually opposite ground electrodes 6*a* and 6*b* are provided which face the circumferential surface of the center electrode 4.

LIST OF REFERENCE SYMBOLS

1. Body
2. Insulator
3. Glass melting
4. Center electrode
5. Seal ring
6. Ground electrode
6*a*. Ground electrode
6*b*. Ground electrode
7. Noble metal piece
8. Noble metal piece
9. Annular shoulder
9*a*. Conical upper side
10. Sealing shoulder
11. Stepped bore
12. Insulator foot
13. Breathing space
14. Annular gap at center electrode
15. Ignition pin
16. Forward end of insulator
17. Forward end of body
18. Shoulder
19. Bore
20. Rear end of insulator
21. Rear end of body
α. Angle
β. Angle
EA. Electrode distance
A-G Dimensions

The invention claimed is:

1. A Spark plug for gasoline engines comprising:
an elongated hollow body made of metal, said body having a forward end with an undercut formed by an interior annular shoulder of the body and a rear end;
an elongated ceramic insulator which is mounted in the body and has a rear end that projects beyond the rear end of the body and has a forward end beyond which the forward end of the body projects;
a center electrode which is inserted into the insulator, projects beyond the forward end of the insulator and the forward end of the body, and is connected to a metal connection pin in an electrically conductive manner;
and at least one ground electrode which starts from the forward end of the body and is approached to the center electrode to an electrode distance between the at least one ground electrode and the center electrode to form a spark gap;
characterized in that the distance of the center electrode from the annular shoulder is greater than or equal to the 1.2-fold electrode distance;
that the distance of the exposed forward end of the insulator from the metal body is greater than or equal to the 1.2-fold electrode distance;
that the distance of the forward end of the insulator from a front side of the annular shoulder is no more than 2 mm plus the 1.2-fold electrode distance;
and that the distance of the exposed forward end of the insulator from the metal body is greater than or equal to the 1.2-fold electrode distance.

2. A spark plug according to claim 1, characterized in that the distance of the forward end of the insulator from the front side of the annular shoulder is no more than 1.5 mm plus the 1.2-fold electrode distance.

3. A spark plug according to claim 1, characterized in that the distance of the forward end of the insulator from the front side of the annular shoulder is no more than 1.3 mm plus the 1.2-fold electrode distance.

4. A spark plug according to claim 1, characterized in that the front side of the annular shoulder coincides with the front side of the body.

5. A spark plug according to claim 1, characterized in that the annular shoulder is delimited by a cylindrical bore the length of which is less than the thickness of the circumferential wall of the metal body, said circumferential wall being adjacent to the annular shoulder.

6. A spark plug according to claim 1, characterized in that the annular shoulder has a conical upper side that faces the insulator.

7. A spark plug according to claim 6, characterized in that the angle (90°-a) measured between the longitudinal axis of the center electrode and the conical upper side of the annular shoulder is 50° to 60°.

8. A spark plug according to claim 6, characterized in that the angle (90°-a) measured between the longitudinal axis of the center electrode and the conical upper side of the annular shoulder is 30° to 75°.

9. A spark plug according to claim 1, characterized in that a cavity of the body is a stepped bore extending throughout the body.

10. A spark plug according to claim 1, characterized in that the forward end of the insulator is blunt.

11. A spark plug according to claim 10, characterized in that the annular shoulder partially overlaps the forward end of the insulator.

12. A spark plug according to claim 11, characterized in that the insulator is tapering towards its forward end and that the tapering section of the insulator is arranged immediately adjacent to the forward blunt end thereof.

13. A spark plug according to claim 10, characterized in that the insulator is tapering towards its forward end and that the tapering section of the insulator is arranged immediately adjacent to the forward blunt end thereof.

14. A spark plug according to claim 1, characterized in that the center electrode is tapering in the area between the forward end of the insulator and the narrowest point of the annular shoulder.

15. A spark plug according to claim 1, characterized in that the insulator is tapering towards its forward end.

16. A spark plug according to claim 15, characterized in that the angle (f3) between the longitudinal axis of the center electrode and the conically tapering surface of the insulator is less than 10°.

17. A spark plug according to claim 16, characterized in that the angle (6) is 5° to 7°.

18. A spark plug according to claim 15, characterized in that the insulator is tapering conically towards its forward end.

* * * * *